US006003730A

United States Patent [19]

David et al.

[11] Patent Number: 6,003,730

[45] Date of Patent: Dec. 21, 1999

[54] HAND HOLDABLE MANUALLY DISPENSING MASTIC CONTAINER

[76] Inventors: Colin Michael David, 1 The Old Hall, South Grove, London N6 6BP; Bernard Jacques David, 49 Clifton Hall, St. John's Wood, London NW8, both of United Kingdom

[21] Appl. No.: 09/043,376

[22] PCT Filed: Sep. 26, 1996

[86] PCT No.: PCT/GB96/02384

§ 371 Date: Mar. 17, 1998

§ 102(e) Date: Mar. 17, 1998

[87] PCT Pub. No.: WO97/11895

PCT Pub. Date: Apr. 3, 1997

[30] Foreign Application Priority Data

Sep. 26, 1995 [GB] United Kingdom ..... 9519633
Feb. 22, 1996 [GB] United Kingdom ..... 9603757

[51] Int. Cl.[6] ..... B65D 35/08; B65D 47/10

[52] U.S. Cl. ..... 222/107; 222/92; 222/541.6

[58] Field of Search ..... 222/92, 107, 541.6

[56] References Cited

U.S. PATENT DOCUMENTS 4,163,509 8/1979 Amneus ..... 222/95
4,795,062 1/1989 Bedwell et al. ..... 222/92

FOREIGN PATENT DOCUMENTS 0 115 163 A1 8/1984 European Pat. Off. .
0 207 440 A2 1/1987 European Pat. Off. .
0 230 115 A1 7/1987 European Pat. Off. .
0 301 878 A1 2/1989 European Pat. Off. .
0 479 687 A1 4/1992 European Pat. Off. .
0 493 723 A1 7/1992 European Pat. Off. .
3211426 A1 10/1985 Germany .
779240 7/1957 United Kingdom .
805631 12/1958 United Kingdom .
2 048 775 12/1980 United Kingdom .
2 119 741 11/1983 United Kingdom .

*Primary Examiner*—Kevin P. Shaver
*Assistant Examiner*—Keats Quinalty
*Attorney, Agent, or Firm*—Woodcock Washburn Kurtz Mackiewicz & Norris LLP

[57] ABSTRACT

A hand holdable manually dispensing mastic container is made from two sheets of transparent plastics material which are welded together at a seam around the periphery thereof. The container is formed to have a dispensing edge and a filling end which are parallel to one another. The container has a generally elongate shape which diverges from the dispensing edge to a widest dimension, and parallel to the dispensing edge, and then converges to the filling end. Thus, two trapezoidal portions are formed. The volume of the portion closest to dispensing edge is smaller than the volume of the portion closest to the filling end.

18 Claims, 2 Drawing Sheets

HAND HOLDABLE MANUALLY DISPENSING MASTIC CONTAINER

The present invention relates to a hand holdable manually dispensing mastic container,.

Mastic is a substance which is used in the construction and repair industry, more particularly it is used for filling dents and scratches etc in the automobile industry.

Mastic is a soft putty like substance having a high viscosity and stickiness. Using the Haake viscometer, for a shear rate (speed of rotation) of 7.22 $s^{-1}$, typical viscosity values are between 3,500 poise and 1,500 poise at 10° C. and 1,500 poise and 650 poise at 30° C. The mastic is typically dispensed onto a planar surface where it is mixed by a spatula with a relatively smaller proportion of hardener in a prescribed proportion to start a chemical reaction which causes the mixture to eventually set or harden within a predetermined hardening time.

The unset mixture should be easily spreadable for application to an automobile, for example, but should not flow once applied to a repair except where a self levelling mixture is used in a self levelling application. The set mixture should provide a smooth hard finish. The hardening time is carefully selected to provide a balance between a usefully long working time and an undesirably long hardening time. To obtain the aforementioned criteria, considerable expertise and care is employed when selecting the chemical components for the mastic. As a result, mastic generally has a high viscosity and contains strong chemical fumes arising from the solvents employed therein. For these reasons, storing and dispensing of the mastic is not an easy matter particularly since such mastics have styrene therein which is very difficult to contain.

Traditionally, for commercial use, mastic is stored in dispensing containers comprising metal tubes filled from one end and with a convergent dispensing nozzle at the other end. An end cap is then forced to slide into the tube by means of a special apparatus or gun so that the mastic is pushed out through the dispensing nozzle. A similar arrangement is also used to dispense the hardener from a small tube.

Traditionally, for non-commercial use in which smaller amounts of mastic are used, metal tubes are not used because their cost is quite high in comparison to the cost of the mastic itself. It should be noted that this cost derives partly from the cost of the metal tube itself and partly from the storage and transport costs associated with empty tubes prior to filling with mastic. Therefore, small cylindrical tins with a lever lid are used instead. The mastic is dispensed by dipping a knife into the mastic and then mixing it with hardener from a tube after removal. However, this is not really satisfactory because the mastic in the tin tends to dry out, the user is more exposed to chemical fumes, and contamination of the filler paste can occur. Furthermore, during filling of the tin, air can be taken up by the mastic resulting in bubbles in the final mixture which detracts from the finish of the set mixture, and the cost of the tin and the filling thereof is quite high. There is also a likelihood of contamination from dust etc in the area.

The aforementioned cylindrical tins, which are of a relatively larger size, are also employed for commercial use. Such metal tins of the tin plate variety have been used because they seal in the fumes from the from the solvents in the mastic, in particular the styrene. Such tins also provide a container which will maintain its integrity, that is to say, they are not subject to leakage over time, and which will not fracture if dropped, a not unusual occurrence in a busy workshop. The latter aspect is an important consideration considering the hazardous nature of the strong chemical fumes and the difficulty of clearing up spilt mastic. Moreover, the interior surface of such tins is not quickly degraded by the chemicals in the mastic so that a reasonably long guaranteed shelf life can be specified.

It has been proposed to use a container made from plastics material. The use of a container made from plastics material should offer a much more cost effective way to deliver the mastic to the end user. In addition, the cost of the container itself should be considerably less than a metal tin, and the container should be able to be produced, transported and filled much more cost effectively than hitherto containers.

U.S. Pat. No. 4,795,062 describes a large bag like container in the form of two generally square two ply sheets of material which are fused together around the four edges to form four connected linear sealing flanges. A nozzle arrangement is then adhered to one sheet with that sheet surface closing the nozzle arrangement until use. Such a container is simpler than the aforementioned metal tubes. However, it is difficult to open the container. Furthermore, the nozzle arrangement can become very messy in use because of the high viscosity and stickiness of the mastic and the nozzle arrangement can also sometimes come away from the sheet surface. In addition, once again, a special dispensing apparatus must be used and hence purchased in order to use the container. This makes such a container particularly unsuitable for the non-commercial usages.

Further problems have been found with mastic containers made from plastic materials. In particular, it has been found that the plastics material selected can not provide a suitable barrier to adequately confine the strong corrosive chemical fumes of the mastic. It has also been found that the seals made of the plastics material do not adequately prevent leakage and can weaken over time making this problem worse. Furthermore, if such a container made from plastics material is dropped, catastrophic failure of the seams can occur. The risk of these problems occurring tends to increase over time making it difficult to specify a reasonably long shelf life, for example 2 years. It has been found that the latter problem derives either from the fact that the plastics material is dissolved by the solvents used in mastic, leading to contamination of the mastic, softening of the container producing distortion of the shape, as well as weakening of the seals and walls, or from the fact that the solvents cause hardening of the container seals and walls leading to leakage and brittleness of the container. Finally, the use of plastics material offers the opportunity of using a clear material providing sight of the mastic. However, it has been found that the plastics material becomes cloudy.

It is an object of the present invention to provide a mastic container which is cheap and easy to produce, which is a hand held container, and which enables manual dispensing.

SUMMARY OF THE INVENTION

According to one aspect of the present invention there is provided a hand holdable manually dispensing mastic container formed of a flexible sheet material and having a generally elongate shape which diverges from a dispensing edge to a widest dimension and then converges to an opposing end.

Prior art mastic containers made from a flexible sheet material are of a form which requires a special apparatus for dispensing. With the present invention, the mastic container has a size such that it is hand holdable and allows comfortable manual dispensing. The ability to hold the container and manually dispense therefrom derives from the container having the defined shape. With this shape, the container sits firmly and snugly in one hand in a manner that enables smooth and well controlled dispensing of the contents by simple pressure applied thereto. Thus, the other hand is left free to control the spatula or mixing board thereby enabling efficient production of the mastic and hardener mixture. Since the mixture is ready quickly, more time is available before hardening occurs compared with the situation where the mixing step take a long time. Moreover, due to the widest dimension, the pressure from the contents can be focused on the dispensing edge to give good dispensing control even when the container is partially empty. In addition, the filled container is balanced during dispensing so that it does not easily fall from the hand.

In one embodiment, the container volume between the opposing end and the widest dimension is greater than the container volume between the dispensing edge and the widest dimension.

Thus, the higher weight volume is disposed towards the body reducing the leverage effect resulting from the weight of the mastic in the container. In addition, the dispensing control is maintained even when a significant proportion of the container contents have been dispensed.

In another embodiment, the container volume between the opposing end and the widest dimension is smaller than the container volume between the dispensing edge and the widest dimension.

Thus, as the mastic is squeezed out, the centre of gravity remains in the region of the palm of the hand thus allowing continued easy manipulation during dispensing.

In still another embodiment, the container volume between the opposing end and the widest dimension is substantially the same as the container volume between the dispensing edge and the widest dimension.

In a preferred embodiment, the length of the container is between 200 mm and 300 mm.

If the length is less than 200 mm, the volume of the container reduces to a point where it limits its application and if the length is greater than 300 mm, the container is unwieldy rendering it effectively no longer easily hand holdable.

Conveniently, the length of the container is between 250 35 mm and 280 mm.

This has been found to be an ideal length for dispensing control from an average sized hand.

In another preferred embodiment, said widest dimension is between 100 mm and 200 mm.

If the widest dimension is less than 100 mm, the volume of the container reduces to a point where it limits its application and if the widest dimension is greater than 200 mm, it exceeds the normal span of the hands which makes the container unwieldy rendering it effectively no longer easily hand holdable.

Conveniently, said widest dimension is between 130 mm and 150 mm.

This has been found to be an ideal dimension for dispensing control from an average sized hand.

Preferably, the container has an average width which exceeds 60 mm.

In a particularly convenient embodiment, the container volume between the opposing end and the widest dimension and the container volume between the dispensing edge and the widest dimension are both generally trapezoidal with their parallel sides parallel to the dispensing edge.

By using a trapezoidal volume, it has been found that the container is simple and hence cost effective to make, with little waste of the sheet material, whilst giving a good feel and balance to the container when manually held. Furthermore, this shape allows pressure to be applied evenly on the trapezoidal volume remote from the dispensing edge which molds to the shape of the hand holding the container.

Preferably, the ratio of the widest dimension to the length of the container is in the region of 0.46 to 0.80.

In one case, said widest dimension is located substantially ⅖'s of the container length from said dispensing edge.

This results in a container which has a good feel and balance when manually held.

In one case, said dispensing edge defines an exit aperture, the exit aperture being formed by cutting along the dispensing edge.

Consequently, the container can be simply opened by cutting along the dispensing edge with the dispensing edge forming the exit aperture. Accordingly, no preformed nozzle is required.

It is preferred that a plurality of cutting guides are provided in the region of said dispensing edge to provide a variety of exit aperture sizes.

In this way, the container exit aperture can be tailored according to the users need or can give a renewed clean edge for future use.

Preferably, the guides comprise notches in flaps disposed adjacent said dispensing edge.

Thus, a simple form of indicating the exit aperture sizes is provided which can be integrated into the container forming thereby avoiding the need for printing or the like.

In one embodiment, the container has opposing walls of said material with side seams joining said wall at least in the region of said dispensing edge.

Conveniently, said seams in the region of the dispensing edge are enlarged to define a pair of flaps for stiffening said exit aperture.

Thus, dispensing control is improved.

In another case, a separate closable nozzle attachment is sealed into the dispensing edge for dispensing relatively less viscous mastic.

As a result, a closure can be attached to the nozzle attachment to prevent the mastic from flowing out.

Conveniently, said nozzle attachment is disposed centrally in the dispensing edge and extends only partially along that edge.

It is preferred that said opposing edge comprises an edge for filling the container.

Thus, simple and quick filling and closure of the container can be obtained without the ingress of air or other gases.

It is preferred that said material is a clear thermoplastic material.

Thus, the user can easily identify the contents of the container.

The present invention encompasses a container as hereinabove described filled with mastic.

According to another aspect of the present invention there is provided a method of dispensing mastic from a container comprising:

filling mastic into a container formed of a flexible sheet material and having a generally elongate shape which diverges from a dispensing edge to a widest dimension and converges to an opposing end;

opening an exit aperture in said dispensing edge; and holding the container in a hand and applying pressure to the container to dispense the mastic from said exit aperture.

Thus, a simple, convenient and clean method of manually dispensing mastic is provided compared with the prior art which does not require a special apparatus. With the present method, the mastic can be manually dispensed in a well controlled manner.

According to still another aspect of the present invention there is provided a mastic container formed of a laminated sheet of plastics material, the sheet comprising:

a layer selected to provide a barrier to chemical components of the mastic and to enable bonding or sealing to another such layer, and an outer covering layer;

wherein the outer covering layer individually or in combination with said first mentioned layer provide structural strength for the container.

In this way, a suitable mastics container can be made from plastics material.

Preferably, said first mentioned layer comprises an inner layer selected to enable bonding or sealing to another such inner layer and an intermediate layer selected to provide a barrier to chemical components of the mastic, said intermediate layer being located between said inner and outer layers.

As a result, an improved seal can be provided enhancing the integrity of the container and reducing the likelihood of leakage.

In one embodiment, said laminated sheet is flexible and said container comprises a non-rigid flexible container.

As a result, it is possible to make a flexible container making it resistant to leakage through breaking.

In a particular embodiment, it is preferred that said inner layer is selected from a polyalkylene, for example polypropylene or polyethylene.

These materials are not dissolved by the mastic or degraded thereby and hence do not react with the mastic so that the container can have a long shelf life. In addition, these materials provide a good seal or bond together during sealing so that leakage at seams or the like is reduced.

In another particular embodiment, said outer layer is a heat resistant material.

By using a heat resistant material, heat can be applied to the sheet will be reach to the inner layer without causing degradation or weakening of the outer layer and the subsequent risk of leakage.

Conveniently, said outer layer is selected from a polyalkylene, for example polypropylene or polyethylene, or a nylon.

These materials provide good structural strength for the container and since the chemical fumes from the mastic are sealed in by the layer providing a barrier, the structural strength of the container is not degraded over time or rendered soft or brittle.

Conveniently, said layer selected to provide a barrier to chemical components of the mastic comprises an alkylene vinyl alcohol co-polymer, for example, ethylene vinyl alcohol co-polymer.

It has been found that ethylene vinyl alcohol co-polymer provides a good barrier to the mastic to cohfine the strong chemical fumes without being degraded thereby over a significant time scale.

In another particular embodiment, the container is vacuum formed from said laminated sheet whereby said container comprises a rigid flexible container.

As a result, a rapid production of containers can be achieved.

Preferably, the container comprises a single piece open topped container.

It has been found that the hitherto used tin can be replaced by a mastic container vacuum formed from the aforementioned material. The container can be made as a single piece with a wide neck enabling a user to access the mastic therein. The structural strength of the container means that even with dropping, the integrity of the container is not compromised by fracturing which is remarkable considering the mass of the mastic, typically in excess of 1 Kg. Furthermore, the container is remains substantially unaffected by the aforementioned solvents so that the container does not become softer or more brittle over normal time limits, which could affect its integrity, and the container shape does not distort over normal time limits so that a suitable shelf life can be specified.

Preferably, the wall thickness of the container is between 650 microns and 900 microns.

It has been found that when the container wall has a thickness within this range, the various advantages mentioned above are optimised.

Conveniently, the container has a substantially flat base with upstanding walls.

Accordingly, it is possible to scrape all the mastic off the base thereby reducing waste.

It is preferred that the container is tub or barrel shaped.

This shape enables good stacking of the full container, good nesting of empty containers, provides optimum use of stacking space, enables a good surface area for labelling etc, and gives a good open access to the mastic for the user.

In a particular embodiment, the area of said base is similar to the area of said open top.

With this embodiment, all the above mentioned advantages are optimised.

Preferably, said single piece container has a lip around the edge thereof and a closure closing the container.

Conveniently, said closure comprises a sealing member sealed to said lip.

By using a closure made from the laminated sheet above, a good seal of the container can be made.

Preferably, said inner layer is selected from a polyalkylene, for example polypropylene or polyethylene.

These materials are not dissolved by the mastic or degraded thereby and hence do not react with the mastic so that the container can have a long shelf life. In addition, these materials provide a good seal or bond together during sealing so that leakage at seams or the like is reduced.

Conveniently, said outer layer is selected from a polyalkylene, for example polypropylene or polyethylene.

These materials provide good structural strength for the container and since the chemical fumes from the mastic are sealed in by the layer providing a barrier, the structural strength of the container is not degraded over time or rendered soft or brittle. Thus, in a rigid container, panelling or bowing of the walls thereof does not occur on a significant time scale.

Conveniently, said layer selected to provide a barrier to chemical components of the mastic comprises an alkylene vinyl alcohol co-polymer for example, ethylene vinyl alcohol co-polymer.

It has been found that ethylene vinyl alcohol co-polymer provides a good barrier to the mastic to confine the strong chemical fumes without being degraded thereby over a significant time scale.

According to yet another aspect of the present invention there is provided a method of forming a mastic container from plastics material, the method comprising the steps of:

(a) forming a laminated sheet comprising a layer selected to provide a barrier to chemical components of the mastic and to enable bonding or sealing to another such layer, and an outer layer selected to individually, or in combination with said first mentioned layer, provide structural strength for the container; and (b) forming said laminated sheet into a container.

As a result, a mastics container can be formed which does not have the above mentioned drawbacks associated therewith.

Preferably, step (a) comprises forming said first mentioned layer as an inner layer selected to enable bonding or sealing to another such inner layer and an intermediate layer selected to provide a barrier to chemical components of the mastic, said intermediate layer being located between said inner and outer layers.

As a result, an improved seal can be provided enhancing the integrity of the container and reducing the likelihood of leakage.

In one case, step (b) comprises vacuum forming a rigid said container.

Consequently, a rigid container can be formed which enables stacking in a nested format thereby reducing the cost of transportation of the empty container prior to use.

In another case, step (b) comprises forming a flexible bag like said container.

By having such a flexible bag like container, it is possible to obtain the advantages of the above mentioned hand held container without the above mentioned drawbacks associated with hitherto containers made of flexible plastics materials.

BRIEF DESCRIPTION OF THE DRAWINGS

Examples of the present invention will now be described with reference to the accompanying drawings, in which.

DETAILED DESCRIPTION OF THE INVENTION

Figure 1:
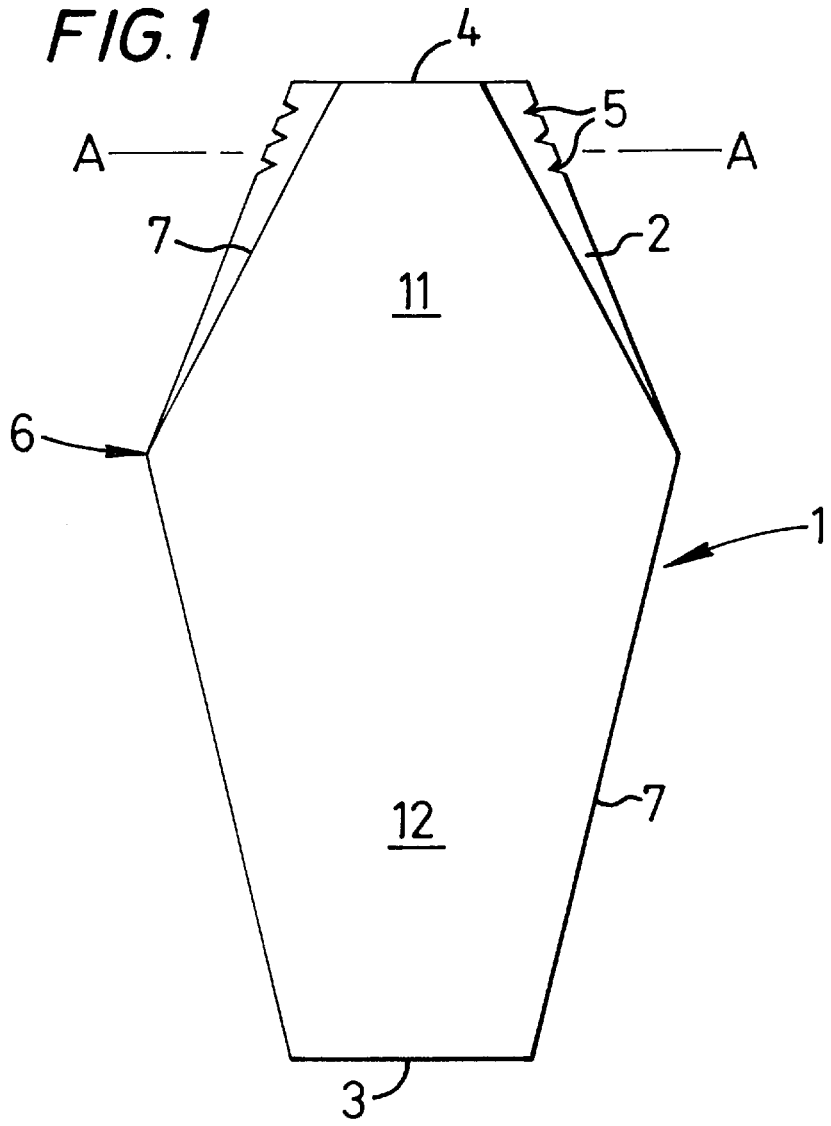
FIG. 1 shows in plan view an unfilled hand holdable manually dispensing mastic container of a first embodiment of the present invention.
Figure 2:
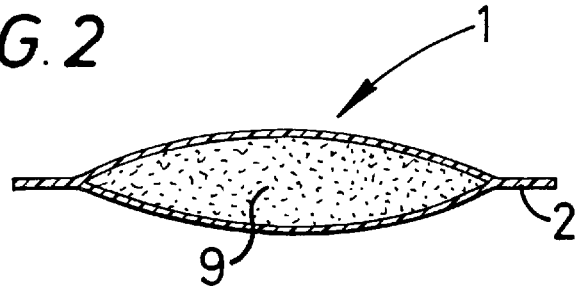
FIG. 2 shows a transverse section along line A—A of FIG. 1 for a filled container.

Referring to FIGS. 1 and 2, a hand holdable manually dispensing mastic container 1 is made from two sheets of transparent plastics material which are welded together at a seam 7 around the periphery thereof. The container is formed to have a dispensing edge 4 and a filling end 3 which are parallel to one another. The container has a generally elongate shape which diverges from the dispensing edge to a widest dimension, indicated by numeral 6 and parallel to the dispensing edge, and then converges to the filling end. The widened dimension 6 is located substantially ⅖'s of the distance along the axis of the elongate shape from the dispensing edge 4 and substantially ⅗'s of the distance along the axis of the elongate shape from the filling end 3.

Thus, two trapezoidal portions are formed generally identified by numerals 11 and 12 respectively. The volume of portion 11 closest to the dispensing edge is smaller than the volume of portion 12 closest to the filling end.

Close to the dispensing edge, the seams 7 are extended sideways as illustrated to form triangular shaped flaps 2. Each flap 2 is provided with three notches 5. The purpose of these will become apparent hereinafter.

The container is made by cutting two sheets of plastics material to have the required shape and then welding them at seams along all edges except along the filling end 3. Then, the container is filled with mastic and the filling end sealed to make a closed container. It will be appreciated that the unfilled container can be made in one location and transported to another location for filling.

To use the container of this embodiment, the seam 7 along the dispensing edge 3 is cut off to expose the mastic. This makes an exit aperture of a predetermined width. The three notches 5 are positioned to provide guides for different widths of exit aperture which in turn enables control of the rate of dispensing of mastic. The flaps 2 also provide an element of stiffness at the dispensing edge leading to improved stability of the exit aperture.

To dispense mastic, the container is held in the hand with the widest dimension 6 fitting into the palm of the hand. Then, pressure is applied to the volume 12 to squeeze out mastic. Due to the shape of the container, the exit aperture can be easily manipulated thereby enabling neat, simple and clean dispensing. In addition, special dispensing apparatus or a special knife are not required. Moreover, the weight of the volume 12 is greater than the weight of volume 11 so overall the weight of the filled container is disposed more towards the body improving control of the exit aperture at the dispensing edge 4.

In the present case, for an average hand length, the length of the container is made to be 260 mm, but can be between 200 mm and 300 mm.

In the present case, for an average hand span, the widest dimension 6 is made to be 140 mm, but can be between 100 mm and 200 mm.

The filling end 3 has a dimension of 30 mm and the dispensing edge 4 and flaps 2 give a combined dimension of 60 mm.

Figure 3:
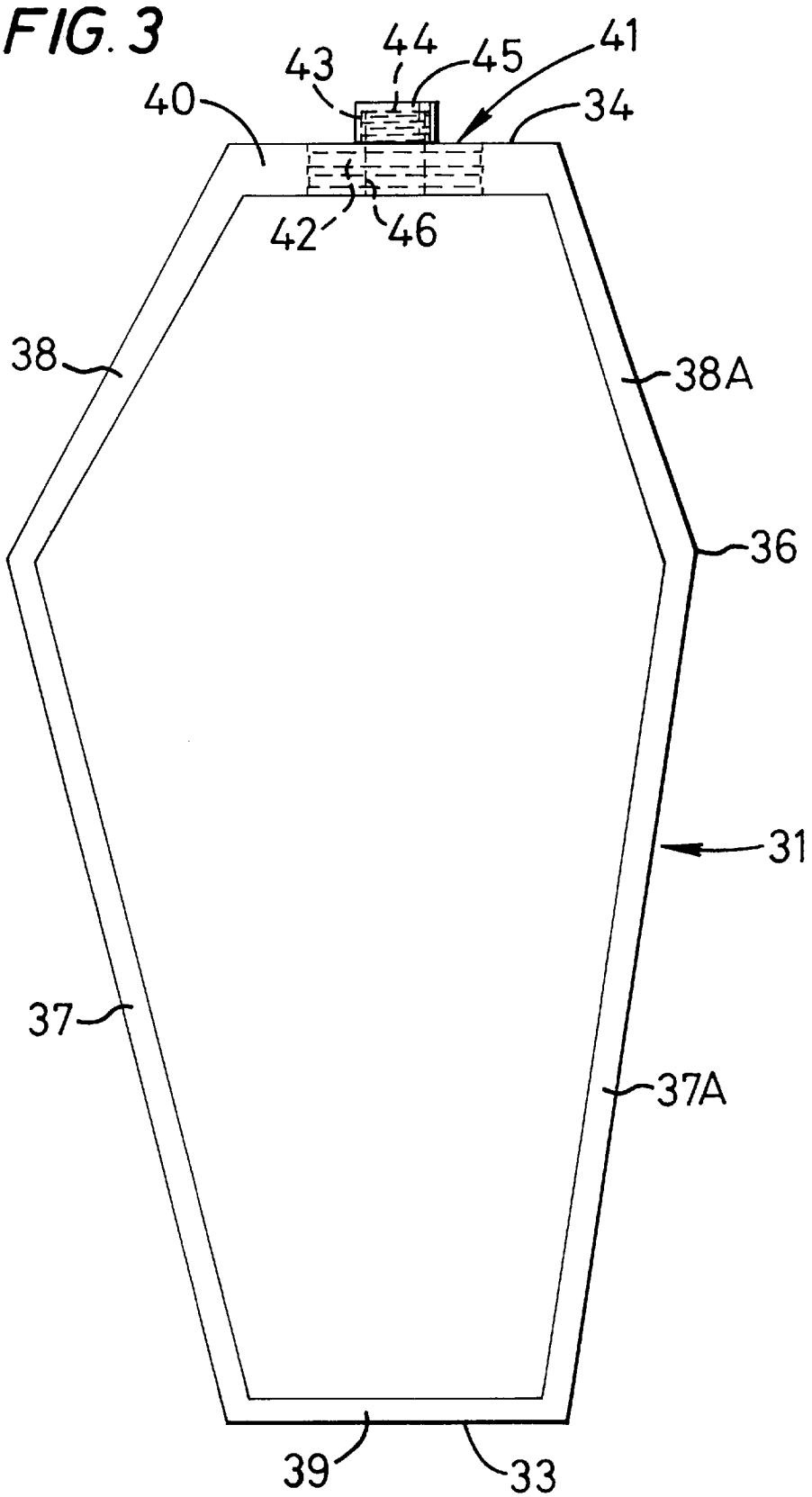
FIG. 3 shows in plan view of an unfilled hand holdable manually dispensing mastic container of a second embodiment of the present invention.

A hand holdable manually dispensing mastic container of a second embodiment of the present invention is shown in FIG. 3. A container 31 is formed of a plastics sheet material which in a preferred form is transparent or translucent. The container is shaped in the form of two trapezoids, one relatively larger, which are joined together at their longer bases to define an intermediate point 36 between a filling end 33 and a dispensing edge 34 of the container. Thus, the intermediate point 36 along the axial length of the container is relatively wider than the filling end 33 and the discharge end 34. The intermediate point 36 is located ⅖'s of the axial length from the discharge end 34 and ⅗'s of the axial length from the filling end 33. The narrowest part of the shape defines the discharge end 34.

Facing surfaces of the container defining the relatively larger trapezoidal shape are sealed together along side seams 37 and 37A. Facing surfaces of the container defining the relatively smaller trapezoidal shape are sealed together along side seams 38 and 38A.

Facing surfaces at the filling end are sealed together along filling end seam 39 after filling. Facing surfaces at the discharge end 34 are sealed together along end seam 40. A nozzle attachment 41 is provided at the discharge end and has a generally inverted T shape defined by a base 42 and an upright 43. The base 42 of the attachment 41 is sealed into the end seam 40. A central discharge channel 46 is formed in the base 42 to extend from the interior of the container 31 through and along the axis of the upright 43 to a discharge exit nozzle 44. The exterior surface of the upright 43 has a thread thereon for receiving a cap 45. A tamper evident or restraining band can be connected to the cap 45 to hold it in place. The exterior surface of the base 42 includes bands for assisting in bonding to the seam 40. The base is disposed centrally along the seam 40, but extends only partially along that seam.

With the second embodiment, all the discharge advantages of the first embodiment are obtained, but instead the container can be sealed with a cap. Thus, the second embodiment can be employed with fluent material that is not sufficiently viscous to stay within the container, but instead has a tendency to flow out, although the use of the nozzle attachment does enable easy closure of the container so that it can still be used with more viscous mastics but a wider exit nozzle and discharge channel are required in this case. By providing the nozzle attachment 41, the container can be closed rather than relying on the inherent viscosity of the material in the container to hold the material therein.

The container of the present invention is simple and cheap to manufacture thus providing convenient and cost effective manufacture in comparison with hitherto known mastic containers. The shape of the container allows comfortable and controlled manually dispensing of the mastic within whilst being held in the hand. As the mastic is squeezed out, the centre of gravity remains in the region of the widest part of the container thus maintaining the seating of the container in the palm of the hand thereby continuing to enable it to be easily manipulated during dispensing. The shape of the container enables pressure to be applied evenly on the larger trapezoidal section which molds to the shape of the hand holding the container. Gentle pressure at this point allows the mastic to be squeezed out.

Moreover, because the container is completely sealed, the mastic therein can remain relatively air free so that the final hardened product after application can have a good finish. Furthermore, because the shape of the container allows more control when the mastic is being squeezed out, the mastic can be squeezed out smoothly and evenly, thus preventing air bubbles from forming. This reduces the likelihood of pin holing in the final hardened product after application. Thus, an improved finish is obtained. In addition, by simple changes to the tooling producing the container, considerable flexibility of size of container can be achieved. In particular, the container can be made to an appropriate size to contain an exact amount of mastic needed for a single application. In this case, the container is disposable after single use thus preventing wastage of material through prolonged storage.

Moreover, whilst a clear thermoplastics sheet material has been described, other forms of sheet material can be used. It should be noted that a clear material may preferably not be used since otherwise the mastic could be subject to degradation due to exposure to ultraviolet light. In addition, the sheet material can take the form of single, two ply or three ply material. It will be appreciated that the flaps 2 and the guides 5 may be omitted as in FIG. 3.

The container shown in the accompanying figures can formed from a laminated sheet of plastics material. The laminated sheet has a layer selected to provide a barrier to chemical components of the mastic and to enable bonding or sealing to another such layer, and an outer covering layer which either individually or in combination with said first mentioned layer provide structural strength for the container.

In one example, the laminated sheet is an easily flexed sheet which is made as an inner layer of polyethylene, an outer layer of polyethylene with an intermediate layer of ethylene vinyl alcohol co-polymer sandwiched therebetween. The three ply layer is produced in sheets.

A roll of the sheet of the three ply material is folded as it passes to a machine such that the inner layers are facing. The machine cuts the sheet to the form shown in FIG. 1 for example and then applies heat around the position of the seams 7. In the present case, the heat causes the inner layers of polyethylene to bond together which together with the fold line along dispensing edge 4 forms a mastic container. The container is then filled through filling end 3 before heat is applied along this edge to cause the inner layers of polyethylene to bond together at this edge sealing the container. Such a machine is well known in the art and does not form part of the present invention. It will be appreciated that microwaves or some other manner of effecting the seal/bond can be employed.

Polyethylene is selected for the inner layer because it is not dissolved by the solvents present in the mastic, for example styrene. Thus, there is no softening or hardening of this layer. Indeed, polypropylene is relatively inert to those solvents so that there is no chemical interaction with the mastic which could cause chemical deterioration. Furthermore, polyethylene provides a very good seal and bond to polyethylene thereby providing leak tight seals 7. However, polyethylene is porous to the solvents and fumes present in, the mastic so it can not be used for the container itself.

After considerable testing, ethylene vinyl alcohol co-polymer is used as the intermediate layer because it has been found to act as a barrier to the chemical fumes present in the mastic thereby ensuring that the container is sealed and does not react to those fumes. Polyethylene is selected as the outer layer because it exhibits very good structural strength so that the integrity of the container is assured. Moreover, neither the polyethylene nor the ethylene vinyl alcohol co-polymer are caused to go cloudy over a significant time so that shelf life is prolonged and the purchaser of the mastic filled container can see the product and check that there has been no deterioration. It should be noted though that it may be preferably to use already opaque materials to prevent deterioration of the mastic due to exposure to ultraviolet light.

It has been found that when the aforementioned flexible sheet is used to make the container of FIG. 3 a problem can arise with heat sealing in the nozzle attachment 41. The problem arise because substantial heat is required to produce bonding between the nozzle attachment and the inner layer. As a result, there is damage to the outer layer resulting in weakening in the vicinity of the attachment leading to bursting if the container is dropped. Thus, in this case it is preferred that a heat resistant material is used for the outer layer. It has been found that an outer layer of nylon is particularly suitable and overcomes the aforementioned weakening problem.

In another example, the laminated sheet is a more rigid sheet which is made as an inner layer of polypropylene, an outer layer of polypropylene with an intermediate layer of ethylene vinyl alcohol co-polymer sandwiched therebetween. The three ply layer is produced in sheets.

A sheet of the material having a thickness of 850 microns is vacuum forming using a standard vacuum forming machine into a mold so as to produce a container which has a generally rectangular base with upstanding walls to define a generally rectangular open top such that a tub shape is formed. The upper edge of the walls have a lip which extends around the periphery of the open top. The container is then filled with mastic and a closure made from the same material as the walls is heat bonded or the like to the lip. This closure is then torn off to open the container. A replaceable lid also of the same material can be provided.

This container has been found to resist leakage of the solvents in the mastic through the base, walls, or closure. In addition, it has been found that the base and walls are resistant to panelling or bowing thereof due to the action of the solvents in the mastic. Moreover, the mastic remains substantially unaffected by contact with the base and walls. Thus, overall, a long shelf life for the mastic can be obtained. Additionally, the material provides significant structural strength which does not significantly alter over time so that even with dropping, the integrity of the container is not compromised by fracturing, and the container shape does not distort over time.

It will be appreciated that whilst the shape of the container described is basically tub shaped, other broad opening container shapes may be selected. The use of vacuum forming is convenient since it is a rapid production process and enables a variety of shapes to be produced.

In tests, it has been found that containers made using the aforementioned plastics materials and which are several years old have retained their integrity in terms of mastic leakage (tested by weight loss) and retain a good visual appearance.

It will be appreciated that whilst an inner layer of polyethylene has been described, this layer can be omitted. Whilst polyethylene has been described for use as the inner and outer layer, the inner and/or outer layer can be polypropylene.

It will be appreciated that the embodiment illustrated shows an application of the invention in one form only for the purpose of illustration. In practice, the invention may be applied to may different configurations, the detailed. embodiments being straightforward for those skilled in the art to implement.

In particular, whilst the shape of the container described is basically that of a reversed double trapezoid conjoined along its longer edges at the widest dimension, other configurations both asymmetric and symmetric may be selected.

With regard to the first embodiment, it will also be appreciated that if use of the container is terminated before the container is empty, the dispensing edge may be freed from mastic, folded back on itself, and retained by adhesive tape or such like so as to exclude air from the container on a temporary basis.

The laminated sheet material described can be made flexible so that it can be applied to different forms and shapes of mastic container. Thus, the material can be used for bag like containers of differing shapes, not limited to those shown in the accompanying drawings. Alternatively, by using a thicker outer layer, the container can be vacuum formed to be rigid with a sufficiently broad opening to enable access of a knife or spatula. The use of vacuum forming is convenient since it is a rapid production process and enables a variety of shapes to be produced. In addition, due to the selection of the intermediate layer compound, the mastic does not cause the walls of the container to degrade such that panelling or bowing occurs. Furthermore, due to the selection of the compounds for the container, it is possible to heat seal or the like a suitable closure to the container, for example foil or the like, which can be easily removed yet provides a leak free seal.

We claim:

1. A hand held mastic container comprising:

mastic;

a flexible sheet material having facing surfaces joined together to define a generally elongate bag-like container shaped in the form of two trapezoidal portions which are joined together at their longer bases, said elongate bag-like container holding said mastic therein and including a dispensing edge having an exit aperture, wherein said dispensing edge is formed in an edge, parallel to said longer base, of one trapezoidal portion, and wherein the exit aperture in said dispensing edge is formed to provide dispensing of the mastic in the container by application of a hand pressure to the facing surfaces of said flexible sheet material.

2. A hand held mastic container according to claim 1 wherein the trapezoidal portion including said dispensing edge has a volume which is greater than the volume of the other trapezoidal portion.

3. A hand held mastic container according to claim 1 wherein the trapezoidal portion including said dispensing edge has a volume which is smaller than the volume of the other trapezoidal portion.

4. A hand held mastic container according to claim 1 wherein the trapezoidal portion including said dispensing edge has a volume which is substantially the same as the volume of the other trapezoidal portion.

5. A hand held mastic container according to claim 1 wherein said container has a length between 200 mm and 300 mm.

6. A hand held mastic container according to claim 5 wherein said container length is between 250 mm and 280 mm.

7. A hand held mastic container according to claim 1 wherein the width of said longer base is between 100 mm and 200 mm.

8. A hand held mastic container according to claim 7 wherein the width of said longer base is between 130 mm and 150 mm.

9. A hand held mastic container according to claim 1 having an average width which exceeds 60 mm.

10. A hand held mastic container according to claim 1 wherein the ratio of said longer base to the length of the container is in a range from 0.46 to 0.80.

11. A hand held mastic container according to claim 10 wherein said longer base is located substantially ⅖'s of the container length from said dispensing edge.

12. A hand held mastic container according to claim 1 wherein said exit aperture is formed by cutting along said dispensing edge.

13. A hand held mastic container according to claim 12 wherein a plurality of cutting guides are provided in the region of said dispensing edge to provide a variety of exit aperture sizes.

14. A hand held mastic container according to claim 13 wherein the cutting guides comprises notches in flaps disposed adjacent said dispensing edge.

15. A hand held mastic container according to claim 1 wherein said facing surfaces are joined together in the region of said dispensing edge to define a pair of flaps for stiffening said exit aperture.

16. A hand held mastic container according to claim 1 wherein a separate closable nozzle attachment is sealed into said dispensing edge to provide said exit aperture.

17. A hand held mastic contained according to claim 16 wherein said nozzle attachment is disposed centrally in said dispensing edge and extends only partially along said dispensing edge.

18. A hand held mastic container according to claim 1 wherein said flexible sheet material is a clear thermoplastic material.

* * * * *